US005802857A

United States Patent [19]

Radkowski et al.

[11] Patent Number: 5,802,857

[45] Date of Patent: Sep. 8, 1998

[54] METHOD OF AND APPARATUS FOR CLEANING COLLECTION CHAIN CONVEYORS

[75] Inventors: Leo M. Radkowski, Evergreen; Roy V. Pogue, Littleton; Larry E. Baumgartner, Morrison, all of Colo.

[73] Assignee: Johns Manville International, Inc., Denver, Colo.

[21] Appl. No.: 880,730

[22] Filed: Jun. 23, 1997

[51] Int. Cl.[6] ..... F25D 13/06

[52] U.S. Cl. ..... 62/63; 62/303; 62/331; 62/374

[58] Field of Search ..... 62/63, 303, 331, 62/374

[56] References Cited

U.S. PATENT DOCUMENTS 5,179,840 1/1993 Worsfold ..... 62/64

5,237,836 8/1993 Byrne et al. ..... 62/385

5,349,828 9/1994 Lee et al. ..... 62/303

*Primary Examiner*—Ronald C. Capossela

*Attorney, Agent, or Firm*—Robert D. Touslee

[57] ABSTRACT

In an apparatus for forming a fibrous mat, fibers and binder are collected on a moving continuous, foraminous collection chain conveyor to form the fibrous mat as the collection chain conveyor travels through a collection chamber. After the fibrous mat is formed on the collection chain conveyor, the fibrous mat is removed from the collection chain conveyor for further processing leaving a residue of fibers and binder on and in openings of the collection chain conveyor. Prior to again traveling through the collection chamber, the collection chain conveyor is cryogenically cleaned by applying a cryogenic liquid (e.g. nitrogen) to the collection chain conveyor to freeze the residue of fibers and binder and by mechanically removing the frozen residue of fibers and binder from the collection chain conveyor, e.g. by agitating, beating and/or brushing the collection chain conveyor.

20 Claims, 2 Drawing Sheets

METHOD OF AND APPARATUS FOR CLEANING COLLECTION CHAIN CONVEYORS

BACKGROUND OF THE INVENTION

The present invention relates to a method of and an apparatus for cleaning the continuous, foraminous collection chain conveyor of a fibrous mat forming process, and in particular to an improved method of and apparatus for cleaning such a collection chain conveyor cryogenically.

Fibrous mats or blankets are currently produced by a number of different fiberization processes from heat-softenable fiberizable materials such as glasses, ceramics, or other minerals and a variety of polymeric materials. In these fiberization processes discrete length or staple fibers are produced by rotary, flame attenuation or other fiberizing apparatus; a binder is sprayed or otherwise applied to the fibers; and the fibers are collected to form a mat on a continuous, foraminous collection chain conveyor passing through a collection chamber by drawing air from the collection chamber through the openings in the collection chain conveyor. After the fibrous mat has been collected, the fibrous mat is removed from the collection chain conveyor, e.g. by being passed to a downstream conveyor for further processing, such as, the curing of the binder in a heated oven.

The removal of the fibrous mat from the collection chain conveyor leaves a residue of fibers and binder, e.g. resin binder, on the surface and in the openings of the collection chain conveyor. This residue of fibers and binder on the surface and in the openings of the collection chain conveyor must be removed from the collection chain conveyor, prior to reintroducing the collection chain conveyor into the collection chamber. Otherwise, the residue of fibers and binder on and in the openings of the collection chain conveyor can interfere with or block the passage of air through the collection chain conveyor and thereby interfere with the uniform and proper collection of fibers and binder on the collection chain conveyor to form the fibrous mat. In addition, buildups or clumps of such residue fibers and binder can break away from the collection chain conveyor and be carried away by the fibrous mat thereby downgrading the quality of the fibrous mat.

Previously, this residue of fibers and binder has been removed from the collection chain conveyor on its return run by blasting high pressure water through the collection chain conveyor and then collecting the water saturated residue for disposal. This method of removing the residue of fibers and binder from the collection chain conveyor requires large volumes of water that must be continuously filtered, treated, and pumped through the collection chain conveyor cleaning system. The energy, maintenance, waste processing and chemical costs associated with this method of removing the residue of fibers and binder is substantial. In addition, for fibrous mat forming processes, such as processes for forming glass fiber mats, the collection chain conveyor must be dry so that the product being collected on the collection chain conveyor is not adversely affected. Thus, for these processes, additional compressed air and blowers are required to dry the collection chain conveyor prior to the reintroducing the collection chain conveyor into the collection chamber.

The problems associated with the collection chain conveyor cleaning methods previously used are solved by the method and apparatus of the present invention for cryogenically cleaning the collection chain conveyor to remove residues of fibers and binder. The method and apparatus of the present invention eliminate the high pressure water cleaning equipment previously used to clean the collection chain conveyor along with the associated maintenance , operating, chemical and disposal costs. The environmental impact of the fibrous mat forming process is reduced by reducing the formation of waste water and water saturated solid waste and reducing the use of chemicals for water treatment and processing. Energy is saved by the elimination of water and slurry pumps, high pressure washing pumps, and compressed air usage to dry the collection chain conveyor. The use of the method and apparatus of the present invention also provides cost reductions due to longer collection chain conveyor service life, improved machine efficiency and product quality improvements.

SUMMARY OF THE INVENTION

The method and apparatus of the present invention provide a means for effectively and efficiently removing the residue of fibers and binder left on the continuous, foraminous collection chain conveyor of a fibrous mat manufacturing process when the fibrous mat is removed from the collection chain conveyor at the end of its collection run. In a preferred embodiment, a cryogenic liquid, preferably liquid nitrogen, is applied directly to the major surfaces of the collection chain conveyor and the residue of fibers and binder on the collection chain conveyor at a freezing station located on the return run of the collection chain conveyor. As the liquid nitrogen undergoes a phase change to a gas, heat is removed from the collection chain conveyor and any residue of fibers and binder present on the surfaces and in the openings of the collection chain conveyor. The removal of heat from the residue of fibers and binder on the collection chain conveyor causes the residue of fibers and binder to become frozen and brittle. The frozen residue of fibers and binder is then mechanically removed from the collection chain conveyor, e.g. by agitating, beating and/or brushing the collection chain conveyor.

Where precooling of the collection chain conveyor and the residue of fibers and binder on the collection chain conveyor is required prior to the application of the cryogenic liquid (e.g. nitrogen) to the collection chain conveyor, to lower the temperature of the residue of fibers and binder sufficiently to freeze the residue of fibers and binder, the collection chain conveyor can be exposed to cryogenic gases (e.g. nitrogen gases) prior to passing into the freezing station. The cryogenic gases used for this precooling are preferably those cryogenic gases produced by the application of the cryogenic liquid to the collection chain conveyor and the residue of fibers and binder in the freezing station. These cryogenic gases are directed from the freezing station to a precooling station located upstream of the freezing station on the return run of the collection chain conveyor.

The cryogenic gases produced from the cryogenic liquid in the freezing station may also be introduced into forming tube and/or collection chamber of the fibrous mat forming process to be exhausted along with the other exhaust gases produced by the fibrous mat forming process. The introduction of the cryogenic gases into these exhaust gases will reduce the temperature of the exhaust gases and thereby reduce exhaust stack temperatures and emissions.

DESCRIPTION OF THE PREFERRED EMBODIMENTS

Figure 1:
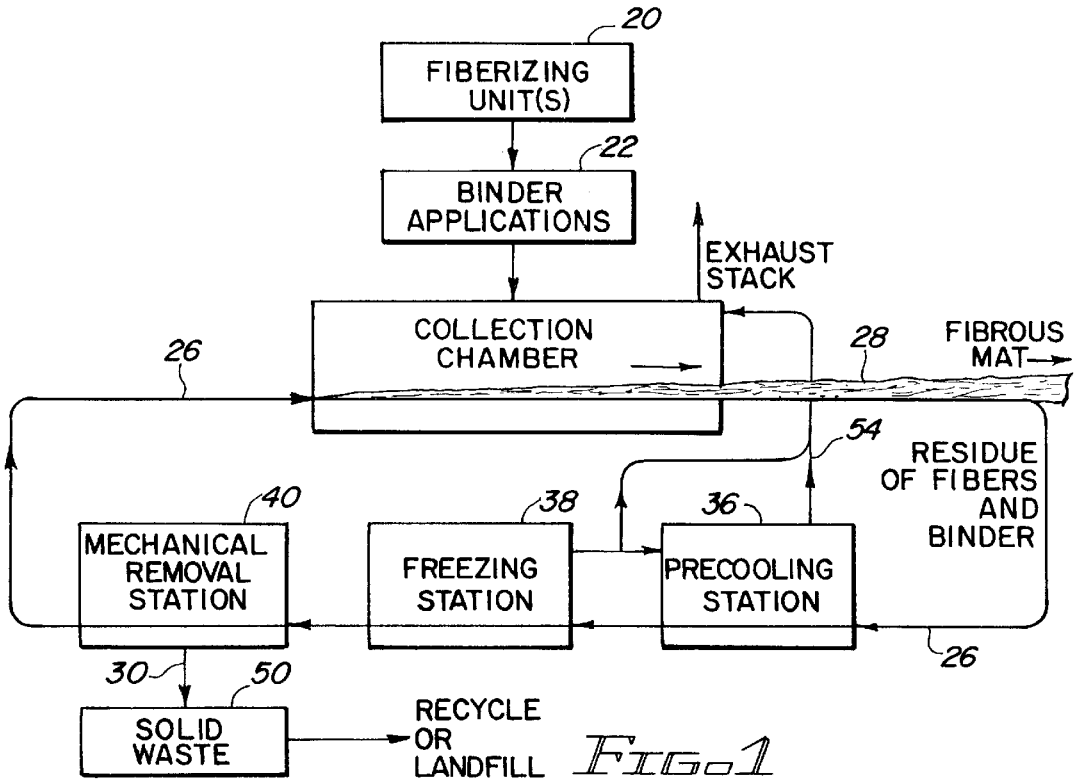
FIG. 1 is a block flow diagram of a fibrous mat forming process using the cryogenic cleaning method and apparatus of the present invention.

Fibrous mats used for thermal and/or acoustical insulation, filtration and other end uses are formed from glass, ceramic, mineral wool and other mineral fibers as well as polymeric fibers. As shown in FIG. 1, a typical fibrous mat forming process includes a fiberizing unit or units 20; a binder applicator or applicators 22; a collection chamber 24; and a driven continuous foraminous metallic collection chain conveyor 26 (e.g. woven stainless steel collection chain conveyor) which passes through the collection chamber 24. The fiberizing unit or units 20, such as but not limited to, conventional rotary fiberizing units or conventional pot and marble flame attenuation units, form a heat-softenable fiberizable material, such as glass, into discrete length fibers. A binder, such as a phenolic resin binder, is sprayed onto or otherwise applied to the fibers by binder applicators 22 which are normally spray nozzles. Within the collection chamber 24, air is drawn through the continuous foraminous chain conveyor 26 by exhaust fans (not shown) to draw the fibers and binder toward the upper surface of the collection chain conveyor 26 as the collection chain conveyor makes its collection run through the collection chamber 24. The fibers and binder are then collected on the upper surface of the continuous foraminous collection chain conveyor 26 as it travels through the collection chamber 24 to form a fibrous mat 28. The fibrous mat 28 is then removed from the collection chain conveyor 26 by passing to a downstream conveyor which carries the fibrous mat through additional process steps such as curing, etc.

When the fibrous mat 28 is lifted or otherwise removed from the collection chain conveyor 26, a residue of fibers and binder remains on the surface and in the openings of the collection chain conveyor 26. If this residue 30 of fibers and binder is not removed from the collection chain conveyor 26, the residue 30 of fibers and binder will clog the openings in the collection chain conveyor on subsequent collection runs through the collection chamber 24 and interfere with the uniform and proper collection of fibers and binder on the collection chain conveyor 26 to form the fibrous mat 28. In addition, buildups or clumps of the residue 30 of fibers and binder on the collection chain conveyor 26 will break off from the collection chain conveyor and become embedded in the fibrous mat 28 thereby adversely affecting the quality of the fibrous mat 28.

In the method and apparatus of the present invention, one and preferably both major surfaces 32 and 34 of the collection chain conveyor 26 are cryogenically cleaned to remove the residue 30 of fibers and binder from the collection chain conveyor 26. The cryogenic cleaning apparatus may include a precooling chamber or station 36; and does include a freezing chamber or station 38 and a residue removal station 40.

Figure 2:
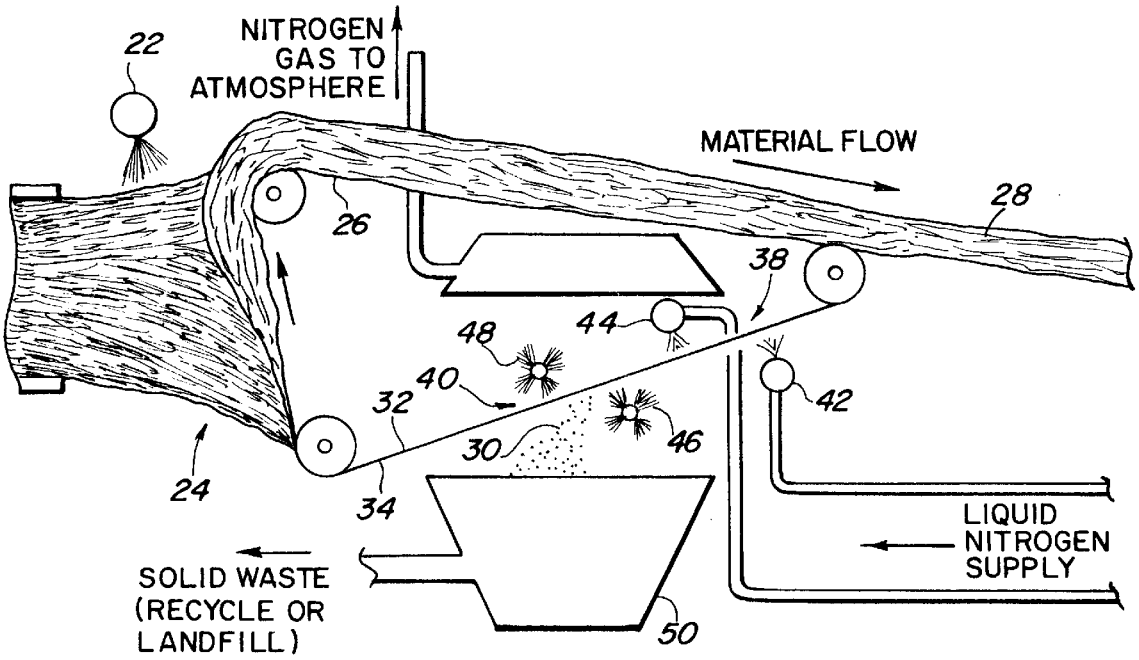
FIG. 2 is a schematic view of a portion of a pot and marble, flame attenuation production line wherein the collection chain conveyor is cryogenically cleaned by the method and apparatus of the present invention.
Figure 3:
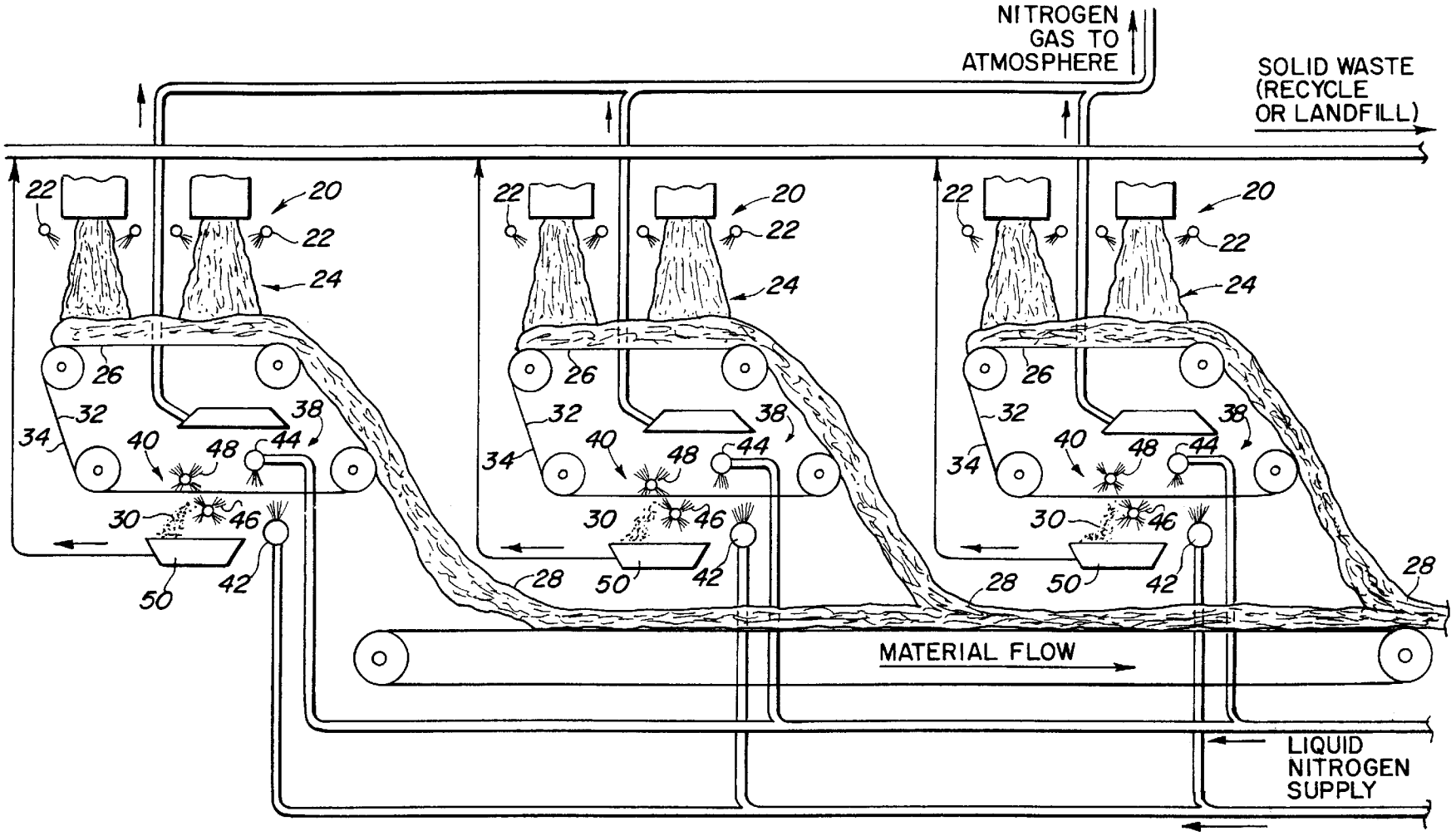
FIG. 3 is a schematic view of a portion of a multi-module production line for forming fibrous mats wherein the collection chain conveyor of each module is cryogenically cleaned by the method and apparatus of the present invention.

As best shown in FIGS. 2 and 3, in the freezing chamber or station 38, a cryogenic liquid (preferably liquid nitrogen) is applied to at least one major surface 34 and, preferably, to both major surfaces 32 and 34 of the collection chain conveyor 26. Preferably, the cryogenic liquid (e.g. nitrogen) is applied to one or both major surfaces 32 and 34 of the collection chain conveyor 26 and the residue 30 of fibers and binder on the surface and in the openings of the collection chain conveyor 26 by spraying the cryogenic liquid onto the surfaces from a plurality of nozzles 42 and 44 extending transversely across the width of the collection chain conveyor 26. As the cryogenic liquid contacts the major surface or surfaces 32 and 34 of the collection chain conveyor and the residue 30 on the surface(s) and in the openings of the collection chain conveyor 26 and undergoes a phase change from a liquid to a gas, heat is withdrawn from the residue 30 of fibers and binder greatly lowering the temperature of the residue 30 of the fibers and binder (e.g. to about −45° F.) causing the residue 30 of fibers and binder (frequently a resin binder) to freeze and become brittle.

The frozen residue 30 of fibers and binder is then removed from the major surface or surfaces 32 and 34 of the collection chain conveyor 26 and openings in the collection chain conveyor 26 at the residue removal station 40. Preferably, the frozen residue 30 of fibers and binder is removed by rotating wire brushes 46 and 48 which extend transversely across the width of the collection chain conveyor 26 or by other mechanical mechanisms which agitate or beat the collection chain conveyor to cause brittle fragments of the residue 30 of fibers and binder to break off from the collection chain conveyor 26. While not preferred, for certain applications, blasts of high pressure air may be used to remove the frozen residue 30 of fibers and binder from the collection chain conveyor 26 alone or in conjunction with one of the mechanical removal mechanisms discussed above, e.g. rotating brushes, agitating mechanisms or beating mechanisms. While shown as a separate station in FIG. 1, the mechanisms for mechanically removing the frozen residue 30 of fibers and binder from the collection chain conveyor 26 can be located within the same chamber or station 38 as the liquid nitrogen applicators.

The frozen residue 30 of fibers and binder removed from the collection chain conveyor 26 is taken from the cryogenic cleaning apparatus by a conveyor, hopper or other conveyance 50. Since the freezing and thawing of the residue 30 of fibers and binder does not damage the fibers and binder, the residue 30 of fibers and binder can be recycled and reintroduced into the process thereby greatly reducing solid waste processing, hauling, and land fill requirements. Of course, the residue of fibers and binder removed from the collection chain conveyor 26 can also be taken to a landfill if desired.

In certain fibrous mat forming processes, the heat transferred to collection chain conveyor 26 during the collection run through the collection chamber 24 may be high enough that the collection chain conveyor 26 and the residue 30 of fibers and binder on and in the openings of the collection chain conveyor 26 need to be precooled prior to entering the freezing station 38 so that the residue 30 of fibers and binder become sufficiently frozen and brittle in the freezing station 38 for effective removal. When precooling is needed or desired in the cryogenic cleaning method and apparatus of the present invention, preferably, the collection chain conveyor 26 and the residue 30 of fibers and binder on and in the openings of the collection chain conveyor are precooled by passing the collection chain conveyor 26 through the precooling station 36. Preferably, the precooling station or chamber 36 is cooled by the cryogenic gas (e.g. gaseous nitrogen) from the freezing station which is pumped while still cold to the precooling station 36 from the freezing station 38 through a gas line or lines 52. After passing through the precooling station 36, the cryogenic gas is preferably delivered through gas line or lines 54 to the collection chamber 24, forming tube, or exhaust stack of the mat forming process to cool the exhaust gases of the process and reduce exhaust gas temperatures and emissions. If the precooling of the collection chain conveyor 26 and the residue 30 of fibers and binder on and in the openings of the collection chain conveyor is not required or desired, the cryogenic gas may be delivered from the freezing station 38 directly to the collection chamber, forming tube or exhaust stack through a bypass line 56 which bypasses the precooling station 36.

FIG. 2 shows a the collection chamber of a typical pot and marble flame attenuation process such as the type normally used to make glass fiber mats. In the embodiment of the invention shown, a precooling station or chamber 36 is not included in the cryogenic cleaning apparatus; the freezing station 38 and the mechanical removal station 40 of the cryogenic cleaning apparatus are located under the same exhaust hood 60; and the cryogenic gas (e.g. gaseous nitrogen) is exhausted directly to the atmosphere. Other than these variations, the cryogenic cleaning apparatus of FIG. 2 is the same as shown in FIG. 1 and functions in the same manner to freeze and remove the residue 30 of fibers and binder from the collection chain conveyor 26.

FIG. 3 shows a multi-module rotary fiberization process such as the type to make glass fiber mats. In the embodiment of the invention shown, a precooling station or chamber 36 is not included in the cryogenic cleaning apparatus; the freezing station 38 and the mechanical removal station 40 of the cryogenic cleaning apparatus are located under the same exhaust hood 60; and the cryogenic gas (e.g. gaseous nitrogen) is delivered directly to the collection chamber 24 after which it is exhausted to the atmosphere. Other than these variations, the cryogenic cleaning apparatus of FIG. 3 is the same as shown in FIG. 1 and functions in the same manner to freeze and remove the residue 30 of fibers and binder from the collection chain conveyor 26.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of cleaning a continuous, foraminous, collection chain conveyor of a fibrous mat forming process wherein fibers and binder are collected on said collection chain conveyor, as said collection chain conveyor travels through a collection run, to form said fibrous mat; said fibrous mat is removed from said collection chain conveyor leaving a residue of said fibers and said binder on and in openings of said collection chain conveyor; and said collection chain conveyor travels through a return run prior to again traveling through a subsequent collection run; comprising:

freezing said residue of said fibers and said binder on and in openings of said collection chain conveyor as said collection chain conveyor travels through said return run to form a frozen residue of said fibers and said binder; and mechanically removing said frozen residue of said fibers and said binder from said collection chain conveyor prior to said collection chain conveyor again traveling through said subsequent collection run.

2. The method of cleaning a continuous, foraminous collection chain conveyor according to claim 1, wherein: said residue of said fibers and said binder is frozen by applying liquid nitrogen to said collection chain conveyor.

3. The method of cleaning a continuous, foraminous collection chain conveyor according to claim 2, wherein: said liquid nitrogen is applied to upper and lower major surfaces of said collection chain conveyor.

4. The method of cleaning a continuous, foraminous collection chain conveyor according to claim 3, wherein: said liquid nitrogen is sprayed onto said upper and said lower major surfaces of said collection chain conveyor.

5. The method of cleaning a continuous, foraminous collection chain conveyor according to claim 4, wherein: said mechanical removal of said frozen residue of said fibers and said binder from said collection chain conveyor is performed by mechanically agitating, beating or brushing said frozen residue of said fibers and said binder from said collection chain conveyor.

6. The method of cleaning a continuous, foraminous collection chain conveyor according to claim 4, including: precooling said collection chain conveyor by exposing said collection chain conveyor to gaseous nitrogen on said return run prior to spraying said liquid nitrogen onto said collection chain conveyor.

7. The method of cleaning a continuous, foraminous collection chain conveyor according to claim 2, including: precooling said collection chain conveyor by exposing said collection chain conveyor to gaseous nitrogen on said return run prior to applying said liquid nitrogen to said collection chain conveyor.

8. The method of cleaning a continuous, foraminous collection chain conveyor according to claim 1, wherein: said mechanical removal of said frozen residue of said fibers and said binder from said collection chain conveyor is performed by mechanically agitating, beating or brushing said frozen residue of said fibers and said binder from said collection chain conveyor.

9. The method of cleaning a continuous, foraminous collection chain conveyor according to claim 2, including:

introducing gaseous nitrogen formed from said liquid nitrogen into exhaust gases of said process to cool said exhaust gases.

10. The method of cleaning a continuous, foraminous collection chain conveyor according to claim 1, wherein: said fibers are glass fibers and said binder is a resin binder.

11. In an apparatus for forming a fibrous mat which includes fiberization means for forming fibers; binder application means for applying binder to said fibers; a collection chamber; a moving continuous, foraminous collection chain conveyor having a collection run passing through said collection chamber for collecting said fibers and binder to form said fibrous mat as said collection chain conveyor travels through said collection chamber and having a return run through which said collection chain conveyor travels prior to again traveling through a subsequent collection run; and means for removing said fibrous mat from said collection chain conveyor prior to said return run which leaves a residue of said fibers and said binder on and in openings of said collection chain conveyor; the improvement comprising:

freezing means for freezing said residue of said fibers and said binder on and in openings of said collection chain conveyor as said collection chain conveyor travels through said return run to form a frozen residue of said fibers and said binder; and removal means for mechanically removing said frozen residue of said fibers and said binder from said collection chain conveyor prior to said collection chain conveyor again traveling through said subsequent collection run.

12. The apparatus for forming a fibrous mat according to claim 11, wherein: said freezing means comprises means for applying liquid nitrogen to said collection chain conveyor to freeze said residue of said fibers and said binder.

13. The apparatus for forming a fibrous mat according to claim 12, wherein: said freezing means applies said liquid nitrogen to upper and lower major surfaces of said collection chain conveyor.

14. The apparatus for forming a fibrous mat according to claim 13, wherein: said freezing means comprises spray nozzles for spraying said liquid nitrogen onto said upper and said lower major surfaces of said collection chain conveyor.

15. The apparatus for forming a fibrous mat according to claim 14, wherein: said removal means for mechanically removing said frozen residue of said fibers and said binder from said collection chain conveyor is a mechanical agitating, beating or brushing means.

16. The apparatus for forming a fibrous mat according to claim 14, including: precooling means for precooling said collection chain conveyor by exposing said collection chain conveyor to gaseous nitrogen on said return run prior to spraying said liquid nitrogen onto said collection chain conveyor.

17. The apparatus for forming a fibrous mat according to claim 12, including: precooling means for precooling said collection chain conveyor by exposing said collection chain conveyor to gaseous nitrogen on said return run prior to applying said liquid nitrogen to said collection chain conveyor.

18. The apparatus for forming a fibrous mat according to claim 11, wherein: said removal means for mechanically removing said frozen residue of said fibers and said binder from said collection chain conveyor is a mechanical agitating, beating or brushing means.

19. The apparatus for forming a fibrous mat according to claim 12, including: means for introducing gaseous nitrogen formed from said liquid nitrogen into exhaust gases of said process to cool said exhaust gases.

20. The apparatus for forming a fibrous mat according to claim 11, wherein: said fibers are glass fibers and said binder is a resin binder.

* * * * *